United States Patent [19]

Teakell

[11] Patent Number: 4,865,013

[45] Date of Patent: Sep. 12, 1989

[54] SELF-ADJUSTING TELESCOPING CONCENTRIC FLUE ASSEMBLY

[75] Inventor: Keith Teakell, St. Louis, Mo.

[73] Assignee: Nordyne, Inc., St. Louis, Mo.

[21] Appl. No.: 276,346

[22] Filed: Nov. 25, 1988

[51] Int. Cl.[4] ..... F23J 1100

[52] U.S. Cl. ..... 126/307 R; 126/312; 98/60

[58] Field of Search ..... 126/85 B, 116 B, 307 R, 126/312, 110 AA 112; 98/36, 48, 60, 62; 237/79; 285/298

[56] References Cited

U.S. PATENT DOCUMENTS 1,328,647 1/1920 Carl ..... 98/46
3,211,079 10/1965 Carlson ..... 126/85 B
3,601,116 8/1971 Davis ..... 126/85 B
4,793,322 12/1988 Shimek et al. ..... 126/85 B

*Primary Examiner*—James C. Yeung
*Attorney, Agent, or Firm*—Jerome A. Gross

[57] ABSTRACT

A self-adjusting, telescoping concentric flue assembly provides non-separating, substantial flexibility between the telescoping sections of both the flue and the air supply ducts. The lower flue and air supply ducts may move radially independently of each other sufficiently to permit installation even on a furnace having somewhat non-concentric flue and air inlet connections. Attachment of the lower air supply duct to the furnace insures that the lower flue is likewise attached, yet the lower air supply duct can be raised independently of the lower flue to check the connection of the latter with the furnace flue connection.

3 Claims, 1 Drawing Sheet

SELF-ADJUSTING TELESCOPING CONCENTRIC FLUE ASSEMBLY

FIELD OF THE INVENTION

The present invention relates to flue assemblies of the type having telescoping annular air inlets as used for furnaces for mobile and modular homes.

BACKGROUND OF THE INVENTION

The furnaces of mobile and modular homes are conventionally supplied with inlet air through an annular duct surrounding the furnace flue, as shown in U.S. Pat. No. 3,691,930. Failure to make or maintain a gas-tight connection between the flue and the furnace may not be discoverable by inspection, once the surrounding air supply duct is secured to the furnace.

Telescoping flue assemblies are used to accommodate variation of distance between furnaces and roofs. These may permit the inner flue to be pulled down simultaneously with the attached outer air supply duct. In U.S. Pat. No. 4,522,191 seating and securing the outer duct provides some assurance that the flue connection has been made. However, with such assemblies, the outer duct cannot be raised independently of the inner flue to verify the flue connections. Furthermore, the type of interconnection shown in that patent provides limited capability for dealing with the problem presented if the furnace flue and duct connections are not perfectly concentric.

SUMMARY OF THE INVENTION

A flue assembly embodying the present invention causes the inner flue to be firmly seated when the outer air supply duct is pulled down and secured to the furnace. While the duct is so attached, the flue cannot become separated from the furnace, as might otherwise occur, for example, during transit. The assembly also permits the air supply duct to be raised independently of the flue, to verify that the flue remains firmly connected; and permit the flue to be secured to the furnace by a screw, should this be desired. Furthermore, the assembly is substantially self-adjusting to account for any lack of concentricity between flue and air duct attachment sites on the furnace.

DESCRIPTION OF THE PREFERRED EMBODIMENT

Figure 1:
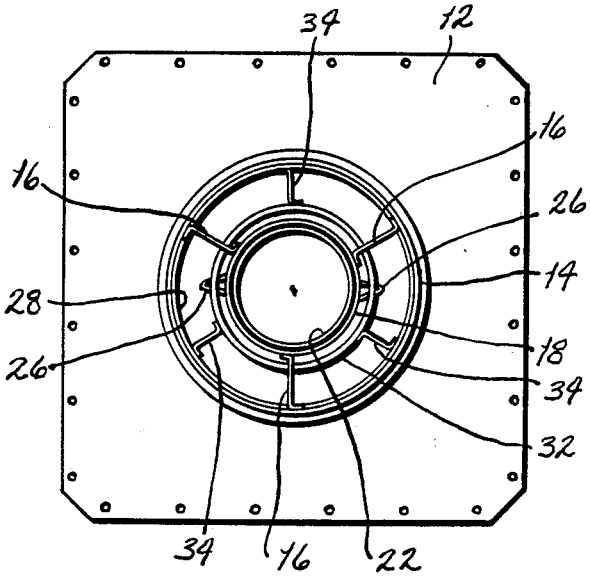
FIG. 1 is a top view of a self-adjusting telescoping concentric flue assembly embodying the present invention.
Figure 2:
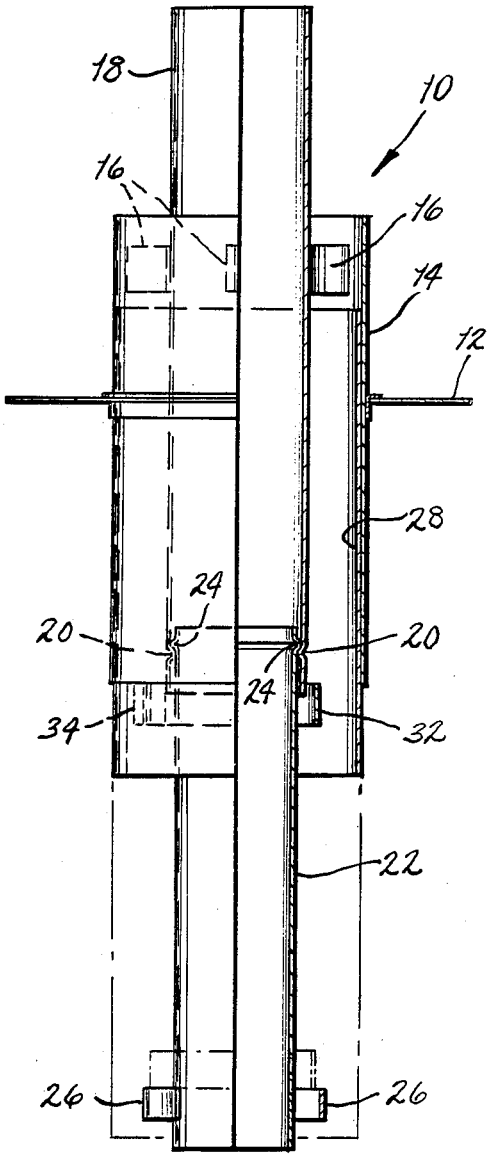
FIG. 2 is a vertical elevational view of the assembly of FIG. 1 with the right side shown in section. Phantom lines illustrate the air supply duct in its lowermost position.
Figure 3:
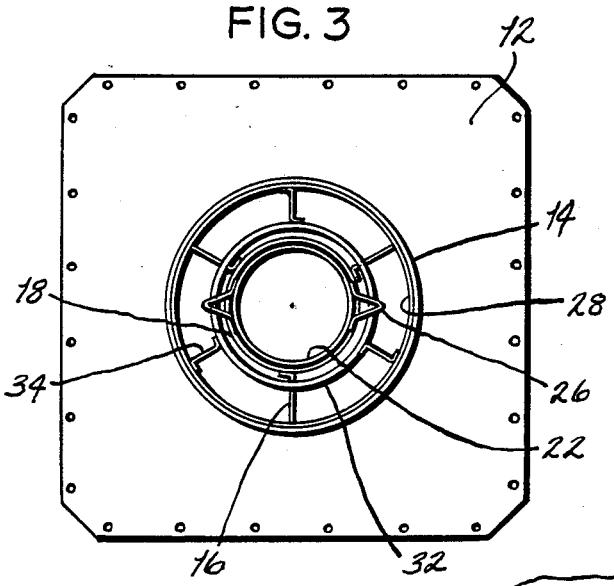
FIG. 3 is a bottom view of the assembly of FIG. 1.

A self-adjusting, telescoping concentric flue assembly, generally designated 10, which embodies the present invention, is shown in FIG. 2. As seen from above in FIG. 1, and below in FIG. 3, the assembly 10 includes a roof flashing 12 secured around the top portion of an upper air supply duct 14. The upper air supply duct 14 has, inside its top end, three brackets 16, secured to and which support the outer top portion of the upper flue

18. At the bottom end of the upper flue 18 is formed an inward extending circumferential bead 20 which limits the downward movement of the lower flue 22 by engaging a similarly formed bead 24 which extends outward near the top of a lower flue 22, now to be described.

The diameter of the lower flue 22 is sufficiently small to permit sliding of its top bead 24 within the upper flue 18, with sufficient friction to support the lower flue 22 and permit a limited amount of tilting. At the bottom end of the lower flue 22 are secured, preferably by spot welds, two outwardly extending angled tabs 26, positioned opposite each other.

A lower air supply duct 28, of slightly smaller diameter than the upper air supply duct 14, fits telescopingly therein beneath the brackets 16 which limit its upward movement. Its telescoping fit is accompanied by enough friction to support the lower duct 28 at any height.

An abutment ring 32 is attached by brackets 34 within the lower portion of the lower air supply duct 28, spacedly above and adjacent to its bottom edge. Both the abutment ring 32 and the stop tabs 26 extend far enough into the annular air inflow space to interfere with each other. The stop tabs 26 are always below the ring 32.

Figure 4:
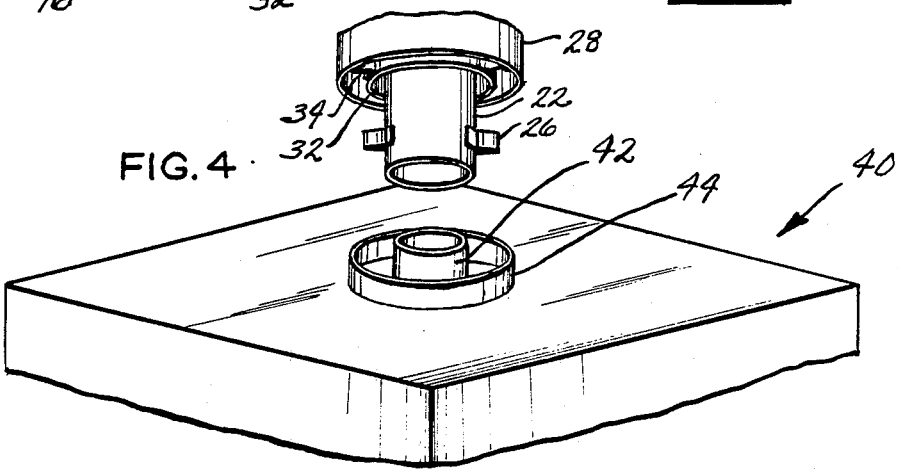
FIG. 4 is a schematic of a view of the assembly about to be installed on a furnace.

The above described flue assembly 10 can be easily installed on a mobile home furnace, generally designated 40 and shown schematically in FIG. 4. The type of furnace 40 illustrated has a collar-like furnace flue connection 42 and thereabout a somewhat lower air inlet connection 44, as shown.

Assuming these are preferably concentric, merely sliding the lower air supply duct 28 down until its abutment ring 32 contacts the stop tabs 26 on the lower flue 22 and continuing to move them downward together, allows the entire assembly 10 to be firmly secured to the furnace 40, by seating the lower air supply duct 28 onto the furnace air inlet connection 44. The lower flue 22 thereby will be firmly seated on the furnace flue connection 42, as the lower air supply duct 28 comes to rest around the furnace air inlet connection 44. This arrangement also permits inspection of the connection of the flue 22 with the furnace 40 by merely raising the lower duct 28; the lower flue 22 will then remain in place as the ring 32 lifts from the tabs 26. On repositioning the lower duct 28 it may be secured to the furnace air inlet connection 44 by a screw.

If the centers of the furnace connections 42, 44 are not precisely concentric with each other or with the upper flue 18, the circumferential bead 24 in combination with the radial freedom of the bottom portions of both the lower flue 22 and the lower air supply duct 28, nevertheless allows the assembly 10 to be easily installed. With the lower duct 28 slightly raised, the lower flue 22 is guided into position and seated on the furnace flue connection 42, which may then be secured by a screw. The lower duct 28 is then drawn downward and out of concentricity with the lower flue 22 to the angular extent necessary to seat it in the furnace air inlet connection 44.

As various modifications may be made in the constructions herein described and illustrated without departing from the scope of the invention, it is intended that all matter contained in the foregoing description or shown in the accompanying drawings shall be interpreted as illustrative rather than limiting.

What is claimed:

1. A self-adjusting, telescoping concentric flue assembly comprising an upper air supply duct, an upper flue of smaller diameter, support means at the upper portion of said upper air supply duct securing said upper flue concentrically within said upper air supply duct, whereby to provide an annular air inflow space therebetween, a lower flue fitted telescopingly within said upper flue, circumferentially formed interengaging means on the top end of said lower flue and the bottom end of said upper flue to permit telescoping movement therebetween without separation thereof and further to permit angular departure of said lower flue from concentricity, together with a lower air supply duct fitted telescopingly within said upper air supply duct beneath said support means, said lower air supply duct having abutment means positioned upwardly adjacent to its bottom end and extending inward into such annular air inflow space, said lower flue having, adjacent to its bottom edge, stop means extending outwardly into such annular air inflow space below and adapted to interfere with said inward-extending abutment means of said lower air supply duct, whereby when said lower air supply duct is drawn downward, such interference causes said lower flue to be drawn downward with it, and thereafter when said lower air supply duct is drawn upward said lower flue remains downward, thereby permitting its positioning and securement separately from the positioning and securement of the lower air supply duct.

2. A self-adjusting concentric flue assembly as defined in claim 1, in which said stop means attached to said lower flue comprises a plurality of tabs outstanding therefrom, and said inward-extending abutment means of said lower air supply duct comprises a ring spaced intermediately between said lower supply air duct and said lower flue, whereby to assure such interference regardless of relative angular positioning of said lower duct and flue.

3. A self-adjusting flue assembly as defined in claim 1, wherein at any position at which said inwardly-extending abutment means of the lower air supply duct interferes from above with said stop means of said lower flue, a length of said flue projects downwardly beyond said air supply duct, such projecting length being sufficient along with said means to permit angular departure, to allow manual guiding of said lower flue.

* * * * *